US005575424A

United States Patent [19]

Fleischmann

[11] Patent Number: 5,575,424

[45] Date of Patent: Nov. 19, 1996

[54] VACUUM BREAKER FOR FAUCETS

[75] Inventor: Gary A. Fleischmann, Sheboygan, Wis.

[73] Assignee: Kohler Co., Kohler, Wis.

[21] Appl. No.: 326,624

[22] Filed: Oct. 20, 1994

[51] Int. Cl.[6] ..... A62C 31/00

[52] U.S. Cl. ..... 239/436; 239/571; 239/588; 4/677

[58] Field of Search ..... 239/571, 574, 239/588, 436; 4/615, 567, 675, 676, 677, 678; 137/217, 218, 855

[56] References Cited

U.S. PATENT DOCUMENTS

| | | | |
|---|---|---|---|
| Re. 21,323 | 1/1940 | Langdon | 137/93 |
| Re. 26,235 | 7/1967 | Woodford | 137/218 |
| 2,219,259 | 10/1940 | Horn | 137/69 |
| 2,282,338 | 5/1942 | Moody | 277/55 |
| 2,502,211 | 3/1950 | Dyer | 137/21 |
| 2,730,117 | 1/1956 | Svirsky | 137/217 |
| 2,740,421 | 4/1956 | Martin et al. | 137/216 |
| 3,056,418 | 10/1962 | Adams et al. | 137/119 |
| 3,104,674 | 9/1963 | Bills et al. | 137/218 |
| 3,286,721 | 11/1966 | Cravits | 137/218 |
| 3,424,188 | 1/1969 | Whitaker et al. | 137/218 |
| 3,461,901 | 8/1969 | Bucknell et al. | 137/119 |
| 3,785,396 | 1/1974 | Morris et al. | 137/359 |
| 3,786,995 | 1/1974 | Manoogian et al. | 239/428 |
| 3,818,929 | 6/1974 | Braukmann | 137/218 |
| 3,862,640 | 1/1975 | Hechler, IV | 137/1 |
| 3,923,081 | 12/1975 | Persson | 137/217 |
| 3,967,638 | 7/1976 | Tondreau | 137/216 |
| 4,008,732 | 2/1977 | Fichter et al. | 137/119 |
| 4,013,089 | 3/1977 | Braukmann | 137/218 |
| 4,176,686 | 12/1979 | Stahle | 137/604 |
| 4,316,480 | 2/1982 | Kah, Jr. | 137/119 |
| 4,326,671 | 4/1982 | Gouguen | 239/66 |
| 4,508,137 | 4/1985 | Bolgert | 137/218 |
| 4,535,807 | 8/1985 | Ericson | 137/533 |
| 4,553,560 | 11/1985 | Tucker et al. | 137/218 |
| 4,635,673 | 1/1987 | Gerdes | 137/216 |
| 4,696,322 | 9/1987 | Knapp et al. | 137/218 |
| 4,726,390 | 2/1988 | Franklin | 137/218 |
| 4,805,661 | 2/1989 | Knapp et al. | 137/218 |
| 4,827,538 | 5/1989 | Heimann et al. | 4/192 |
| 4,874,006 | 10/1989 | Iqbal | 137/119 |
| 4,909,270 | 3/1990 | Enterante, Sr. et al. | 137/107 |
| 4,969,483 | 11/1990 | Knapp | 137/218 |
| 4,974,632 | 12/1990 | Ericson | 137/526 |
| 4,977,920 | 12/1990 | Oberdorfer | 137/218 |
| 4,991,623 | 2/1991 | Ericson | 137/526 |
| 5,009,247 | 4/1991 | Oberdorfer | 137/218 |
| 5,022,429 | 6/1991 | Rollini et al. | 137/218 |
| 5,060,687 | 10/1991 | Gayton | 137/218 |
| 5,090,062 | 2/1992 | Hochstrasser | 4/192 |
| 5,095,554 | 3/1992 | Gloor | 4/192 |
| 5,103,856 | 4/1992 | Fleischmann | 137/218 |
| 5,213,131 | 5/1993 | Gnauert et al. | 137/218 |
| 5,213,268 | 5/1993 | Gnauert et al. | 239/571 |
| 5,217,040 | 6/1993 | Hochstrasser | 137/218 |
| 5,279,324 | 1/1994 | Schutz et al. | 137/218 |
| 5,325,885 | 7/1994 | Ivan et al. | 137/217 |
| 5,329,957 | 7/1994 | Semchuck et al. | 137/218 |
| 5,361,431 | 11/1994 | Freier et al. | 4/678 |

*Primary Examiner*—Andres Kashnikow
*Assistant Examiner*—Lisa Douglas
*Attorney, Agent, or Firm*—Quarles & Brady

[57] ABSTRACT

A faucet with a vacuum breaker for a pull-out spray head plumbing fixture is provided. The vacuum breaker is placed in the faucet housing immediately under a valve unit and has fluid inlets and an outlet all passing therethrough. The vacuum breaker also has a multiplicity of openings extending through a base portion. A flapper gasket is stretch fitted over the base portion. The vacuum breaker affords ease of installation and removal. A check valve is placed immediately adjacent to the vacuum breaker.

13 Claims, 4 Drawing Sheets

55
54
36
37
40
39
12
34
30
32
57
56
49
18
10
25
43
14
42
11
28
24
17
20
21
29
52
23
15
19
50
51
2
54
34
12
18
20
15
16
19
26
27
28
2

VACUUM BREAKER FOR FAUCETS

BACKGROUND OF THE INVENTION

A. Field of the Invention.

This invention relates primarily to vacuum breakers for faucets. More particularly, the invention relates to vacuum breakers for use with faucets having a pull-out spray function.

B. Description of the Art

Pull-out spray head faucets are often used in kitchen and bar sink faucets. These types of faucets, however, pose special problems in that if the spray head is placed in contact with dirty water, and the supply of water is interrupted, the water supply could become contaminated by a back siphoning of the dirty water. Vacuum breakers have therefore been previously provided in conjunction with such pull-out spray heads.

Some prior art vacuum breakers for pull-out spray heads have shortcomings in that they present valving devices which require specially designed venting compartments. Others are multicomponent valving devices and/or devices which are not easily installed or repaired. Other systems do not afford vacuum breakers which are easily and economically manufactured. Thus, it can be seen that a need exists for an improved vacuum breaker useful with pull-out spray faucets.

SUMMARY OF THE INVENTION

In one aspect, the invention provides a faucet housing having a first bore in communication with a fluid inlet and fluid outlet, and a second bore. A valve unit is positioned in the first bore for regulating fluid flow from the fluid inlet to the fluid outlet. A pull-out spray unit is removably mountable adjacent a terminus of the second bore and connected to a tube, the tube extending into the second bore and being axially movable therein.

A conduit extends between the first bore and the tube. A vacuum breaker is positioned in the first bore between the fluid inlet and valve unit. The vacuum breaker has a base section with a fluid entry passage, a fluid exit passage and at least one air passage, all three passing therethrough. The fluid entry passage is in communication with the fluid inlet, the fluid exit passage is in communication with the fluid outlet, and the air passage is in communication at one end with atmosphere and at another end with the conduit (when the other end is not closed). A flapper valve is mountable to removably cover the other end of the air passageway so as to permit air entry into the conduit during reduced pressure conditions, the flapper valve having a gasket with a central hole and also a peripheral portion that surrounds the base section.

In one aspect, there are a multiplicity of such air passages, and they are positioned in opposing groups.

In another aspect, a check valve is positioned in the conduit in fluid communication with the vacuum breaker exit passage.

In still another aspect, the base section includes locator openings for the valve unit, two fluid inlets, and one outlet positioned inward of the opposing groups of air passages.

In another embodiment, the invention provides a vacuum breaker for use with a faucet having a pull-out spray unit. A cylindrically shaped body member has a base portion with a multiplicity of air passageways extending therethrough. A flapper valve is mounted to removably close the air passageways. It surrounds the base portion. There are at least one fluid inlet and fluid outlet also extending through the base portion.

The vacuum breaker is easily connected or disconnected from a valve housing and is composed of few parts.

The objects of the invention therefore include:

a. providing a faucet of the above kind which can effect a vacuum breaker function in a pull-out spray apparatus as well as provide ease and efficiency in installation and operation;

b. providing a faucet of the above kind which can be manufactured easily and with a few parts and thus at reduced cost;

c. providing a faucet of the above kind which can be easily repaired;

d. providing a faucet of the above kind which permits a compact and an aesthetic design; and e. providing a faucet of the above kind where the vacuum breaker is easily aligned with a valve cartridge and the valve housing.

These and still other objects and advantages of the invention will be apparent from the description which follows. In the detailed description below, a preferred embodiment of the invention will be described in reference to the accompanying drawings. The embodiment does not represent the full scope of the invention. Rather the invention may be employed in other embodiments.

DESCRIPTION OF THE PREFERRED EMBODIMENT

Figures 1, 2:
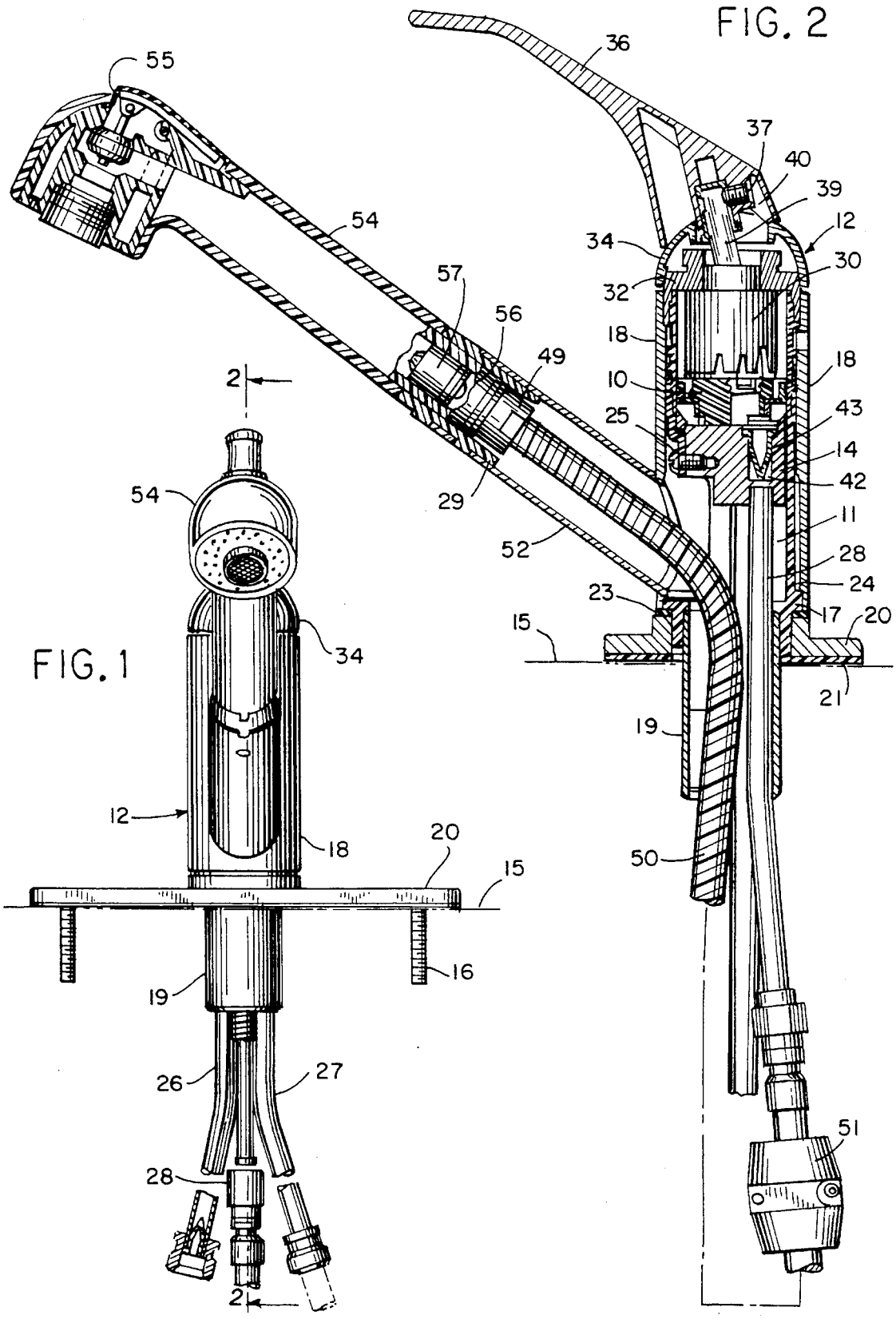
FIG. 1 is a front elevational view showing a faucet employing the vacuum breaker of this invention.
FIG. 2 is a sectional view taken along line 2—2 of FIG. 1.

Referring to FIGS. 1 and 2, the vacuum breaker, generally 10, is shown in conjunction with a faucet, generally 12, having a valve body 14 housed inside a valve housing 24 having an axial bore 11. A spout hub 18 surrounds the valve housing 24 and is seated thereon by the flange 17. Valve housing 24 is secured to an escutcheon 20 and the counter top 15 by the usual screws 16. Gaskets 21 and 23 are provided between the counter top 15 and the escutcheon 20, as well as between the outer valve housing 24 and the escutcheon 20.

Figure 3:
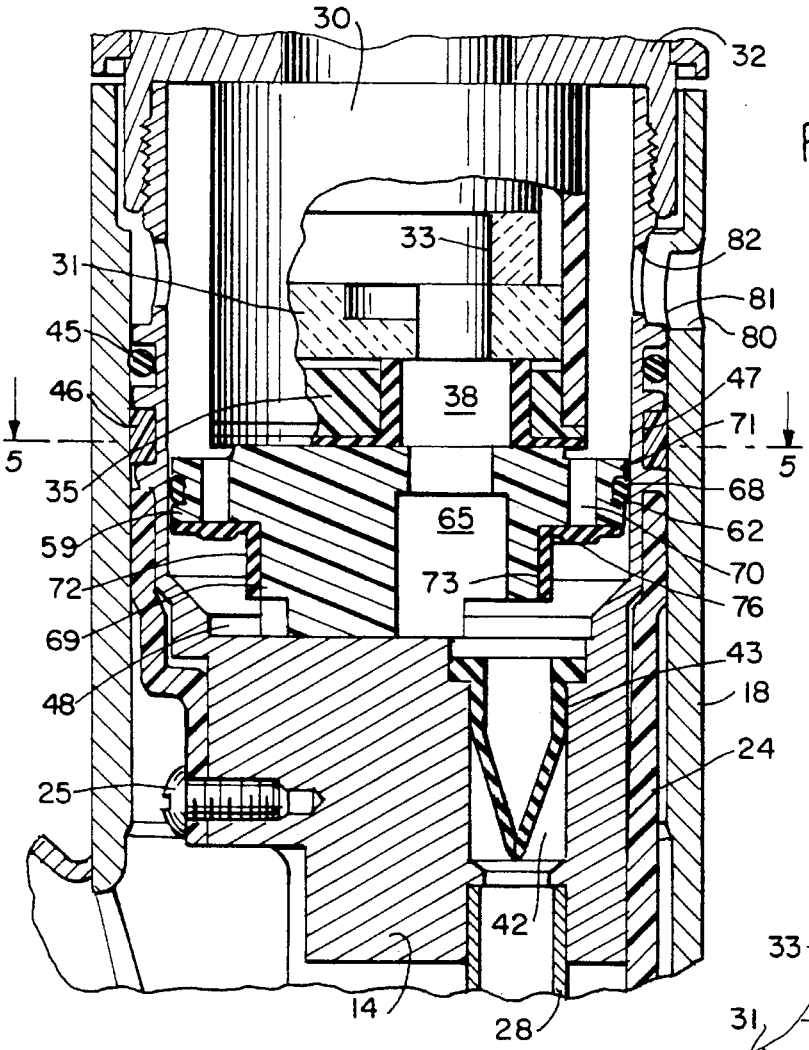
FIG. 3 is an enlarged detailed sectional view of the vacuum breaker, with the flapper valve shown in a closed position.
Figure 4:
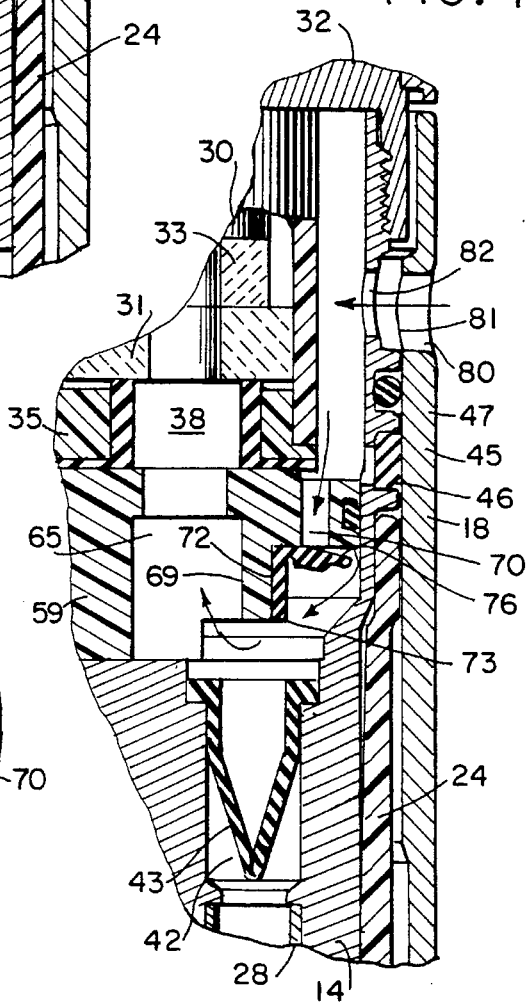
FIG. 4 is a view similar to FIG. 3, albeit showing the vacuum breaker in an open position.
Figure 5:
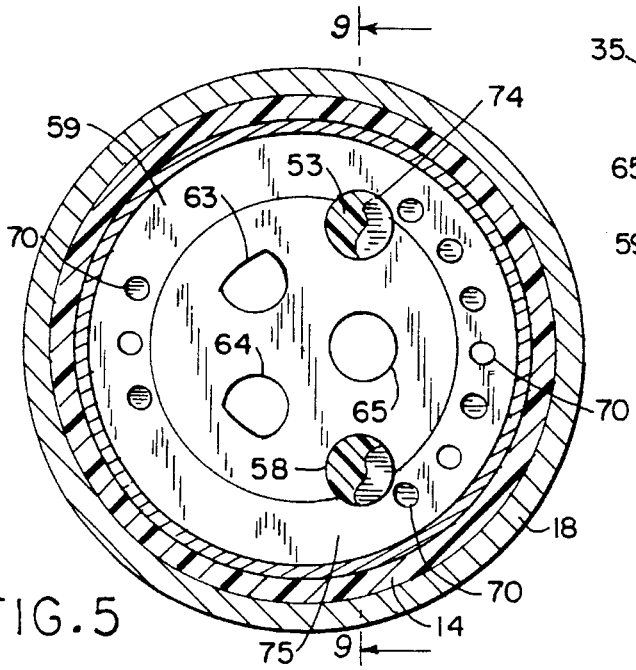
FIG. 5 is a sectional view taken along line 5—5 of FIG. 3.
Figure 6:
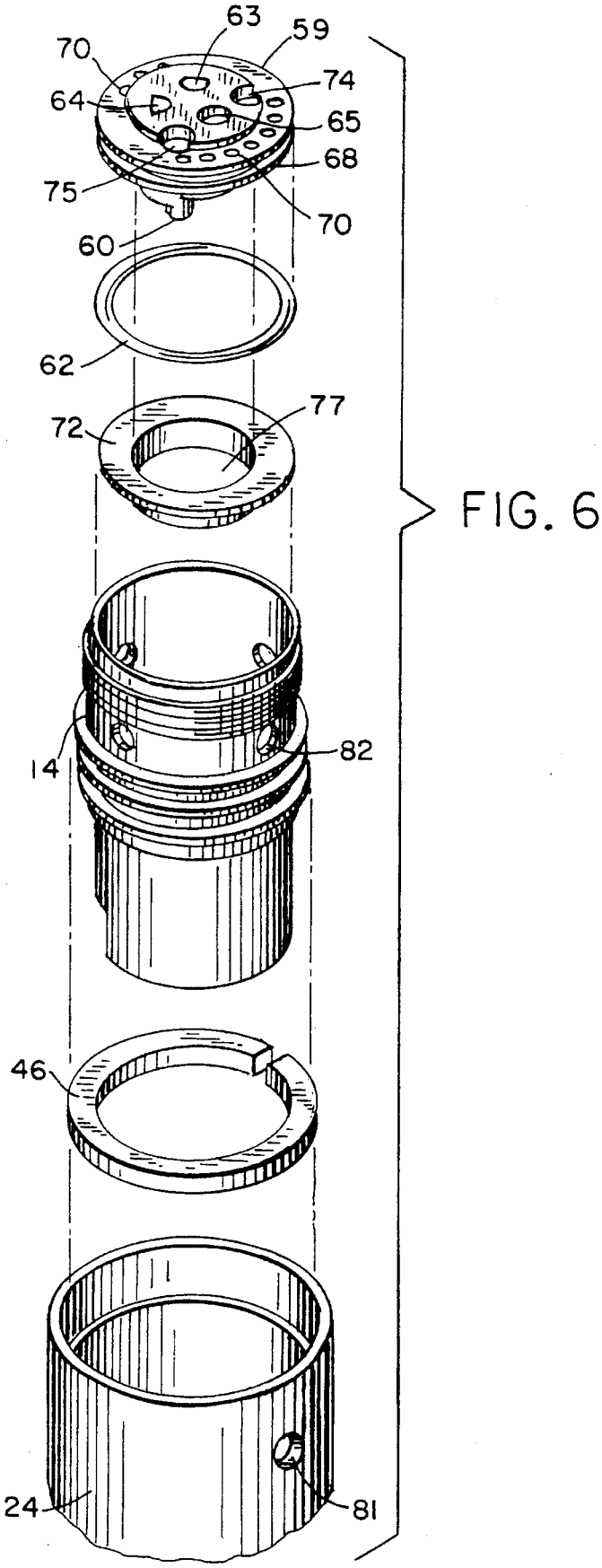
FIG. 6 is an exploded perspective view of certain of the vacuum breaker parts shown in FIGS. 3 and 4.

Referring to FIGS. 3 and 4, a secure fitment is afforded between spout hub 18 and valve housing 24 by the seal 45 and slip ring 46 placed therebetween. They are retained in grooves such as 47.

Figure 7:
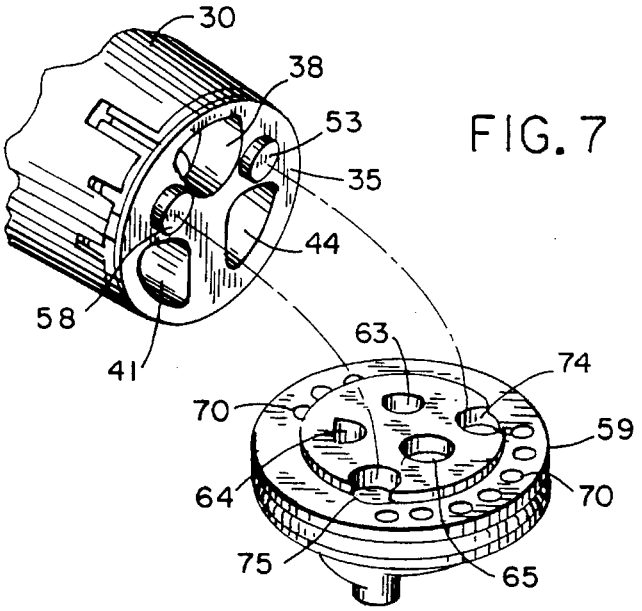
FIG. 7 is an exploded perspective view showing the valve unit positioned for assembly on the vacuum breaker.
Figure 8:
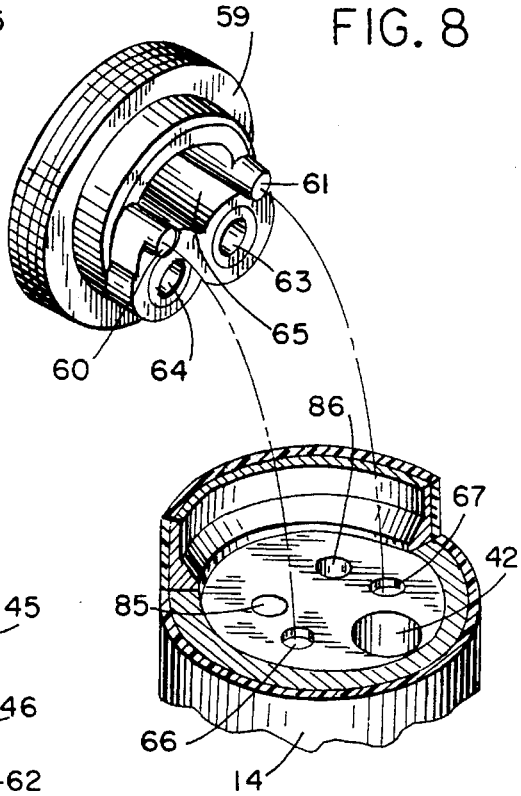
FIG. 8 is a view similar to FIG. 7 showing the vacuum breaker ready to be positioned on the valve body.
Figure 9:
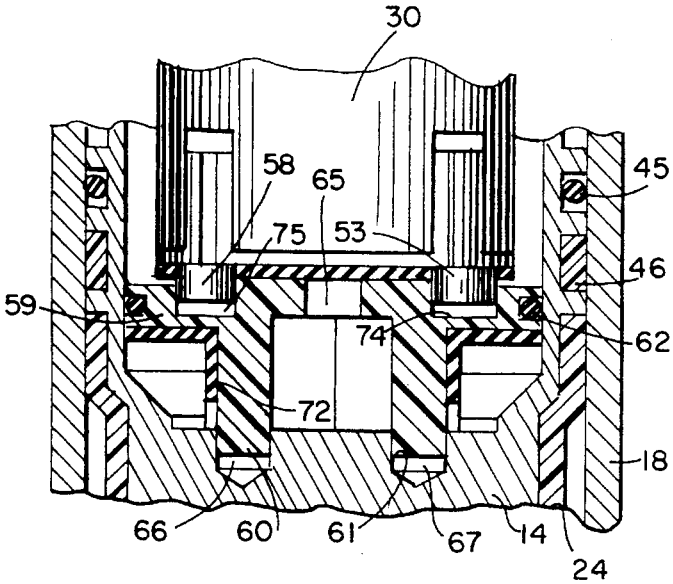
FIG. 9 is a view in cross section showing inter alia, the parts of FIGS. 7 and 8 in an assembled condition.

As seen in FIGS. 1–4, hot and cold water inlet pipes 26 and 27 deliver hot and cold water to the valve body 14 which is connected in the valve housing 24 by the screw 25. Valve body 14 has suitable passages for delivering the hot and cold water to the valve 30. A mounting nut 32 secures the valve 30 in the valve body 14, and a bonnet 34 covers the nut 32 and is connected thereto. Valve 30 is of the ceramic disk cartridge type having a base member 35 with hot and cold water passages 41 and 44 extending therethrough (See FIG. 7), a stationary disk 31, and a movable disk 33 operable by the valve stem 39 for regulating the flow of water to outlet passage 38 in the base member 35 of valve body 14. A valve regulating handle 36 is connected to the valve stem 39 by the screw 37 passing through the opening 40.

A duck bill type check valve 43 is seated in the outlet passage 42 of valve body 14. Outlet passage 38 delivers mixed hot and cold water, as well as a mixture thereof, to outlet passage 42 and outlet line 28 which in turn is connected to the flexible hose 50. Hose 50 extends back through a lower valve body portion 19 and into spout 52 of spout hub 18 where it is attached to spray head 54 by the nut 49 threadably engaging housing 56. A poppet type check valve 57 with flow control which is available from Ferna U.S.A. located in Woodland Hills, Calif. is disposed in the housing 56. An optional valve unit 55 is located at the end of the spray head 54. The spray head 54 is seated on the end of spout 52 when it is not extended and is guided therein by insert 29. The weight 51 on hose 50 assists in a retractable seating.

Disposed in valve body 14 and immediately below valve 30 is the vacuum breaker 10, the details of which are seen in FIGS. 3–9. Vacuum breaker 10 has a cylindrical body 59 which is sealed in the valve body 14 by the sealing ring 62 disposed in groove 68. Water inlet passages 63 and 64 and water outlet passage 65 extend through cylindrical housing 59 for the purpose of supplying water to valve 30 such as with inlets 41 and 44 and flowing water therefrom as from outlet 38. Two blind valve locator holes 74 and 75 act in conjunction with valve locator pins 53 and 58 to orientate the inlet passages 63 and 64 and the outlet passage 65 with the corresponding passages inlet passages 44 and 41 and outlet passage 38 of the valve 30. There are also locator pegs 60 and 61 extending from vacuum breaker body 59 for orientating with holes 66 and 67 in the valve body 14.

Circumferentially positioned apertures 70 extend through a large diameter portion 71 of the vacuum breaker housing 59. For ease of plastic molding, the apertures 70 do not extend completely around housing 59. A diaphragm 72, composed of an elastic material, provides a flapper valve having a central hole 77 for stretch fitting onto the reduced diameter portion 69. An annular portion 76 extends from the collar portion 73 for purposes of surrounding and covering apertures 70 in the large diameter portion 71 of body 59.

Under normal operating conditions, the annular portion 76 covers the apertures 70 so that pressurized water in the passage 48 between vacuum breaker housing 59 and valve body 14 cannot flow through the apertures 70. This would be the normal operating condition of the faucet 12 when pressurized water is flowing therethrough from outlet passage 65 to outlet passage 42. It should be noted that even when there is not a pressurized condition in passage 48, the annular portion 76 covers the apertures 70. This is illustrated in FIG. 3.

In the event of a loss of pressure in the water supply lines 26 and 27, and the spray head 54 were left in the gray or dirty water of a sink, the gray water could be drawn into the water supply by means of the hose 50 and outlet line 28. A reduction in pressure in the valve body 14, passage 42 and passage 48 causes the annular portion 76 to be drawn downwardly and away from the apertures 70 thus drawing air in from the atmosphere to break the vacuum as illustrated by the direction arrows in FIG. 4. Air is easily drawn in through the apertures 80, 81 and 82 of spout hub 18, valve housing 24 and valve body 14, respectively. Diaphragm 72 thus functions as a one-piece flapper valve.

An important feature of the vacuum breaker 10 is the positioning between the valve 30 and the valve body 14. This obviates having to design a separate compartment to house it and allows for ease of placement or replacement of the vacuum breaker 10 in the valve body 14. Another important feature is the surrounding of the diaphragm 72 over the vacuum breaker housing 59 to close and open the apertures 70. This provides a quick assembly of the vacuum breaker 10.

It will therefore be appreciated that a vacuum breaker 10 is provided which simplifies the design of the valve body in eliminating specially designed compartments. By placing the vacuum breaker 10 adjacent and immediately below the valve 30, a compact design is realized. This also affords ease of assembly in the valve body.

Still another feature of the vacuum breaker 10 is the simplified construction. It requires only a one-piece diaphragm 72 stretched over the body 59 of the vacuum breaker 10.

Yet another feature is the placement of the check valve 43 in the valve body 14. This obviates having to provide a separate housing in the outlet line.

Thus, the invention provides an improved valve assembly. While a preferred embodiment has been described above, it should be readily apparent to those skilled in the art that a number of modifications and changes may be made without departing from the spirit and scope of the invention. For example, while a particular plumbing valve has been shown, other valves can be used with the vacuum breaker. Also, the specific materials mentioned are not the only materials which can be used. All such and other modifications within the spirit of the invention are meant to be in the scope of the invention.

I claim:

1. A faucet, comprising:

a faucet housing having a first bore in communication with a fluid inlet and fluid outlet, and a second bore;

a valve unit positioned in the first bore for regulating fluid flow from the fluid inlet to the fluid outlet;

a pull-out spray unit removably mountable adjacent to a terminus of the second bore and connected to a tube, the tube extending into the second bore and being axially movable therein;

a conduit between the first bore and the tube;

a vacuum breaker positioned in the first bore between the fluid inlet and valve unit, the vacuum breaker having a base section with a fluid entry passage, a fluid exit passage and at least one air passage, the three passages all passing therethrough, the fluid entry passage being in communication with the fluid inlet and with a fluid passageway of the valve unit, the fluid exit passage being in communication with the fluid outlet and with a fluid vent of the valve unit, and the air passage communicating at one end with atmosphere and at another end with the conduit when the other end is not closed; and a flapper valve mountable to removably cover the other end of the air passageway so as to permit air entry into the conduit during reduced pressure conditions, the flapper valve having a gasket with a central hole and also a peripheral portion that surrounds the base section.

2. The faucet of claim 1, wherein the valve unit is in the form of a cartridge that contains two ceramic disks.

3. The faucet of claim 1, wherein the valve unit is spaced from a wall of the faucet housing to provide an air path to an air passageway.

4. A faucet, comprising:

a faucet housing having a first bore in communication with a fluid inlet and fluid outlet, and a second bore;

a valve unit positioned in the first bore for regulating fluid flow from the fluid inlet to the fluid outlet;

a pull-out spray unit removably mountable adjacent to a terminus of the second bore and connected to a tube, the tube extending into the second bore and being axially movable therein;

a conduit between the first bore and the tube;

a vacuum breaker positioned in the first bore between the fluid inlet and valve unit, the vacuum breaker having a base section with a fluid entry passage, a fluid exit passage and a multiplicity of air passages positioned in opposing groups with all of the passages passing therethrough, the fluid entry passage being in communication with the fluid inlet, the fluid exit passage being in communication with the fluid outlet, and the air passages communicating at one end with atmosphere and at another end with the conduit when the other end is not closed; and a flapper valve mountable to removably cover the other end of the air passageways so as to permit air entry into the conduit during reduced pressure conditions, the flapper valve having a gasket with a central hole and also a peripheral portion that surrounds the base section.

5. The faucet of claim 1 wherein the base section includes locator openings for the valve unit positioned inward of the opposing groups of air passages.

6. The faucet of claim 5, wherein the base section has two fluid inlets and one fluid exit positioned inward of the opposing groups of air passages.

7. A faucet, comprising:

a faucet housing having a first bore in communication with a fluid inlet and fluid outlet, and a second bore;

a valve unit positioned in the first bore for regulating fluid flow from the fluid inlet to the fluid outlet;

a pull-out spray unit removably mountable adjacent to a terminus of the second bore and connected to a tube, the tube extending into the second bore and being axially movable therein;

a conduit between the first bore and the tube;

a vacuum breaker positioned in the first bore between the fluid inlet and valve unit, the vacuum breaker having a base section with a fluid entry passage, a fluid exit passage and at least one air passage, the three passages all passing therethrough, the fluid entry passage being in communication with the fluid inlet, the fluid exit passage being in communication with the fluid outlet, and the air passages communicating at one end with atmosphere and at another end with the conduit when the other end is not closed;

a check valve positioned in the conduit in fluid communication with the vacuum breaker exit passage; and a flapper valve mountable to removable cover the other end of the air passageways so as to permit air entry into the conduit during reduced pressure conditions, the flapper valve having a gasket with a central hole and also a peripheral portion that surrounds the base section.

8. The faucet of claim 7 wherein the check valve is positioned immediately adjacent the vacuum breaker.

9. A vacuum breaker for use with a faucet having a pull-out spray unit and a valve unit having a fluid passageway and a fluid vent, comprising:

a cylindrically shaped body member having a base portion with a multiplicity of air passageways extending therethrough;

a flapper valve mounted to removably close the air passageways and surrounding the base portion; and at least one fluid inlet for communication with the fluid passageway of the valve unit and a fluid outlet for communication with the fluid vent of the valve unit extending through the base portion.

10. The vacuum breaker of claim 9, wherein there are two fluid inlets.

11. The vacuum breaker of claim 9, wherein there are locator members extending from the body member for seating in a faucet housing.

12. A vacuum breaker for use with a faucet having a pull-out spray unit comprising:

a cylindrically shaped body member having a base portion with a multiplicity of air passageways extending therethrough;

a flapper valve mounted to removably close the air passageways and surrounding the base portion;

at least one fluid inlet and fluid outlet also extending through the base portion, the base portion having locator openings for a valve unit positioned inward of the air passageways.

13. A vacuum breaker for use with a faucet having a pull-out spray unit comprising:

a cylindrically shaped body member having a base portion with a multiplicity of air passageways extending therethrough;

a flapper valve mounted to removably close the air passageways and surrounding the base portion;

at least one fluid inlet and fluid outlet also extending through the base portion, the fluid inlet and fluid outlet being positioned inwardly of the air passageways.

* * * * *

UNITED STATES PATENT AND TRADEMARK OFFICE

CERTIFICATE OF CORRECTION

Patent No. : 5,575,424

Dated : November 19, 1996

Inventor(s) : Gary A. Fleischmann

It is certified that error appears in the above-identified patent and that said Letters Patent is hereby corrected as shown below:

Claim 7

Column 6, line 12 before "cover" "removable" should be --removably--.

Signed and Sealed this

Twenty-second Day of April, 1997

Bruce Lehman

*Attest:*

BRUCE LEHMAN

*Commissioner of Patents and Trademarks*

*Attesting Officer*